US006308838B1

(12) United States Patent
Endean

(10) Patent No.: US 6,308,838 B1
(45) Date of Patent: Oct. 30, 2001

(54) FOOTWEAR STORAGE RACK

(76) Inventor: Ronald C. Endean, 314 Thorold Road, Ilford, Essex IG1 4HD (GB)

( * ) Notice: Subject to any disclaimer, the term of this patent is extended or adjusted under 35 U.S.C. 154(b) by 0 days.

(21) Appl. No.: 09/439,339

(22) Filed: Nov. 12, 1999

(51) Int. Cl.[7] ..... A47F 7/08
(52) U.S. Cl. ..... 211/37; 211/34; 211/205
(58) Field of Search ..... 211/37, 34, 36, 211/39, 163, 205; D6/412; 36/109

(56) References Cited

U.S. PATENT DOCUMENTS

D. 379,881 * 6/1997 Gregg et al. ..... D6/457
2,619,741 * 12/1952 Clark ..... 36/109
3,802,572 * 4/1974 Shackel ..... 211/38
4,534,471 * 8/1985 Zahn et al. ..... 211/39
5,772,050 * 6/1998 Shih ..... 211/39

* cited by examiner

*Primary Examiner*—Daniel P. Stodola
*Assistant Examiner*—Erica B Harris

(57) ABSTRACT

A footwear storage rack for supporting and storing footwear such as Wellington boots. The footwear storage rack includes a base, a tubular support member having a lower portion with a slot therein and further having an upper portion with a retractable catch member therein, a footwear support member being essentially a disk and having a plurality of wedge-shaped slots extending in the circumference and spaced thereabout, and a handle removeably attachable to the upper portion of the tubular support member for carrying and moving the footwear storage rack as desired.

1 Claim, 2 Drawing Sheets

FIG. 2
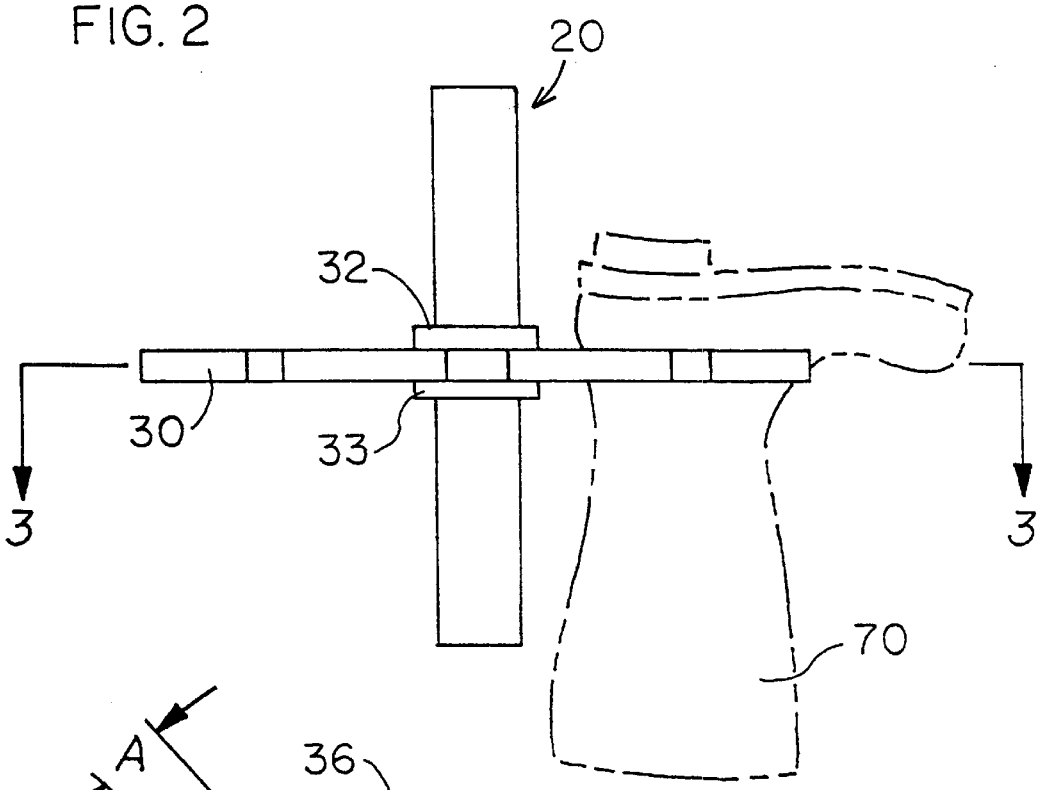
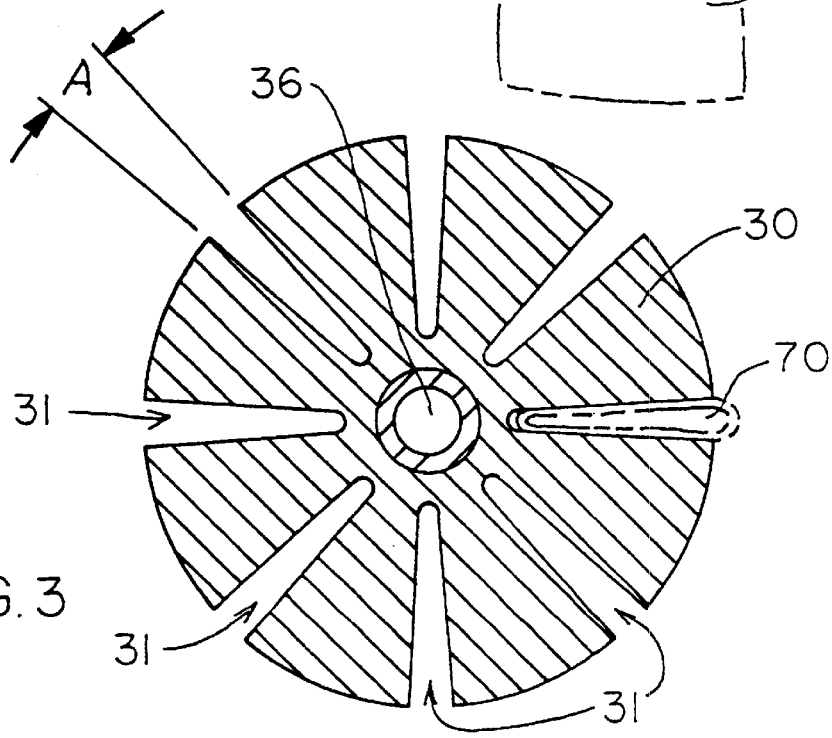
FIG. 3

FOOTWEAR STORAGE RACK

BACKGROUND OF THE INVENTION

1. Field of the Invention

The present invention relates to a means for supporting and storing footwear and more particularly pertains to a new footwear storage rack for easily and conveniently supporting and storing footwear such as Wellington boots.

2. Description of the Prior Art

The use of a means for supporting and storing footwear is known in the prior art. More specifically, a means for supporting and storing footwear heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,688,685; U.S. Pat. No. 3,472,389; U.S. Pat. No. 3,762,573; U.S. Pat. No. 5,772,050; U.S. Pat. No. 3,161,294; and U.S. Pat. No. 3,874,512.

While these devices fulfill their respective, particular objectives and requirements, the aforementioned patents do not disclose a new footwear storage rack. The inventive device includes a base means, a tubular support member having a lower portion with a slot therein and further having an upper portion with a retractable catch member therein, a footwear support member being essentially a disk and having a plurality of wedge-shaped slots extending in the circumference and spaced thereabout, and a handle means removeably attachable to the upper portion of the tubular support member for carrying and moving the footwear storage rack as desired.

In these respects, the footwear storage rack according to the present invention substantially departs from the conventional concepts and designs of the prior art, and in so doing provides an apparatus primarily developed for the purpose of easily and conveniently supporting and storing footwear such as Wellington boots.

SUMMARY OF THE INVENTION

In view of the foregoing disadvantages inherent in the known types of a means for supporting and storing footwear now present in the prior art, the present invention provides a new footwear storage rack construction wherein the same can be utilized for easily and conveniently supporting and storing footwear such as Wellington boots.

The general purpose of the present invention, which will be described subsequently in greater detail, is to provide a new footwear storage rack which has many of the advantages of the a means for supporting and storing footwear mentioned heretofore and many novel features that result in a new footwear storage rack which is not anticipated, rendered obvious, suggested, or even implied by any of the prior art a means for supporting and storing footwear, either alone or in any combination thereof.

To attain this, the present invention generally comprises a base means, a tubular support member having a lower portion with a slot therein and further having an upper portion with a retractable catch member therein, a footwear support member being essentially a disk and having a plurality of wedge-shaped slots extending in the circumference and spaced thereabout, and a handle means removeably attachable to the upper portion of the tubular support member for carrying and moving the footwear storage rack as desired.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new footwear storage rack which has many of the advantages of the a means for supporting and storing footwear mentioned heretofore and many novel features that result in a new footwear storage rack which is not anticipated, rendered obvious, suggested, or even implied by any of the prior art a means for supporting and storing footwear, either alone or in any combination thereof.

It is another object of the present invention to provide a new footwear storage rack which may be easily and efficiently manufactured and marketed.

It is a further object of the present invention to provide a new footwear storage rack which is of a durable and reliable construction.

An even further object of the present invention is to provide a new footwear storage rack which is susceptible of a low cost of manufacture with regard to both materials and labor, and which accordingly is then susceptible of low prices of sale to the consuming public, thereby making such footwear storage rack economically available to the buying public.

Still yet another object of the present invention is to provide a new footwear storage rack which provides in the apparatuses and methods of the prior art some of the advantages thereof, while simultaneously overcoming some of the disadvantages normally associated therewith.

Still another object of the present invention is to provide a new footwear storage rack for easily and conveniently supporting and storing footwear such as Wellington boots.

Yet another object of the present invention is to provide a new footwear storage rack which includes a bas e means, a tubular support member having a lower portion with a slot therein and further having an upper portion with a retractable catch member there in, a footwear support member being essentially a disk and having a plurality of wedge-shaped slots extending in the circumference and spaced thereabout, and a handle means removeably attachable to the upper portion of the tubular support member for carrying and moving the footwear storage rack as desired.

Still yet another object of the present invention is to provide a new footwear storage rack that allows the user to neatly arrange and store footwear.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevational view of the present invention.

FIG. 3 is a top plan view of the footwear support member of the present invention.

DESCRIPTION OF THE PREFERRED EMBODIMENT

Figure 1:
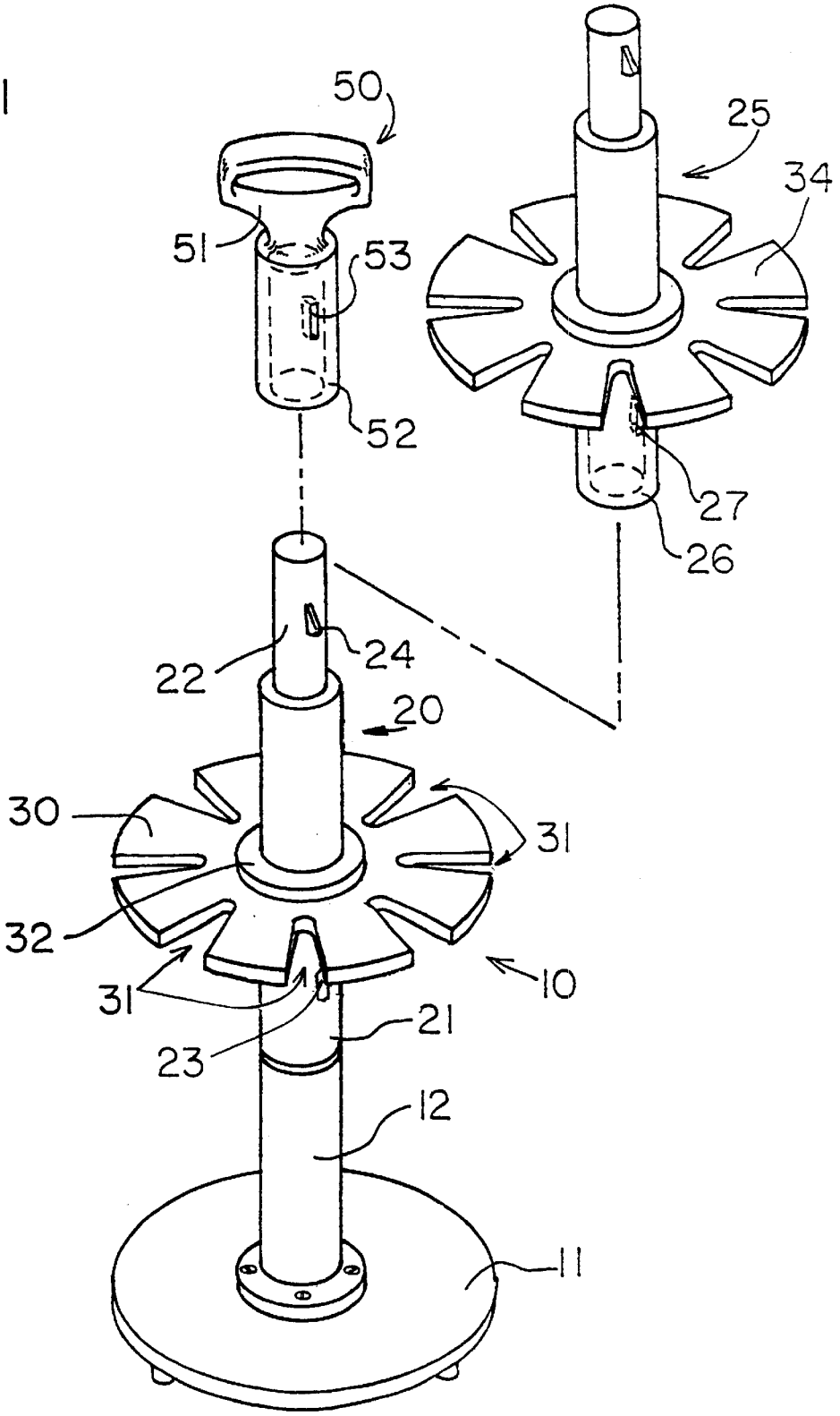
FIG. 1 is an exploded perspective view of a new footwear storage rack according to the present invention.

With reference now to the drawings, a new footwear storage rack embodying the principles and concepts of the present invention and generally designated by the reference numeral 10 will be described.

As best illustrated in FIGS. 1 through 3, the footwear storage rack 10 generally comprises a base means including a base member 11 and a tubular member 12 being securely mounted with conventional means upon the base member 11 and extending upwardly therefrom. At least one tubular support member 20, 25 is removeably and securely mounted to a top of the base means and extending upwardly therefrom and includes a lower portion 21 having a slot 23 therein and also includes a recessed upper portion 22 having a retractable catch member 24 therein. Each tubular support member 20, 25 includes a means for removably attaching said tubular support members 20, 25 in an end-to-end manner. The upper portion 22 of the tubular support member 20 removeably receives the lower portion 26 of another tubular support member 25. The catch member 24 of the upper portion 22 being removeably received in the slot 27 of the lower portion 26. At least one footwear support member 30 having a hole 36 therein is securely mounted about the tubular support member 20 with a pair of annular flanges 32,33 and has a plurality of slots 31 therein for supporting footwear 70 and being securely and conventionally mounted about a middle portion of the tubular support member 20. The footwear support member 30 is essentially a disk with the slots 31 being spaced about the circumference of the footwear support member 30 and being extended inwardly thereof. Each of the slots 31 is wedge-shaped so as to retain a portion of a footwear retained therein. The at least one footwear support member includes at least one additional footwear support member 34 that is securely mounted about tubular support member 25. A means for carrying the rack is removeably mounted to the upper portion of one of the tubular support members 20, 25. The first embodiment the means for carrying the rack includes a handle means 50 including a tubular lower portion 52 and an upper handle portion 51, the tubular lower portion 52 having a slot 53 therein. The upper portion 22 of one of the tubular support members 20 is adapted to removeably receive the tubular lower portion 52 of the handle means 50, the slot 53 of the tubular lower portion 52 being adapted to receive the catch member 24 of one of the tubular support members 20.

In use, footwear such as Wellington boots would be stored and supported by the footwear storage rack 10 by the user inserting the boot 70 preferably upside down with the middle portion or neck portion just above the instep being wedged or inserted in one of the slots 31 in one of the footwear support members 30. The boots are essentially suspended from the footwear storage rack 10 which could include a plurality of the tubular support members 20,25 which would extend from the floor to the ceiling or which could include simply one tubular support member 20 with the handle means 50 being removeably attached to the upper portion 22 of the tubular support member 20.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A footwear storage system comprising:

a boot having a leg portion and a foot portion, wherein the boot has a relatively more flexible leg portion and a relatively stiffer foot portion;

a rack including:

a base;

at least one tubular support member being removably and securely mounted to a top of said base and extending upwardly therefrom;

at least one footwear support member being securely mounted about said at least one tubular support member and having a plurality of slots therein for supporting footwear;

a means for carrying said rack; and each of said slots being defined by a pair of edges, said pair of edges linearly converging toward a central area of said footwear support member such that the edges pinch the relatively more flexible leg portion of said boot so that a relatively stiffer foot portion of the boot is resisted from slipping through said slot when the boot is placed in an inverted condition in said slot.

* * * * *